US007513053B1

(12) United States Patent
Sidebottom, Jr.

(10) Patent No.: US 7,513,053 B1
(45) Date of Patent: Apr. 7, 2009

(54) CHALK LINE ANCHORING DEVICE

(76) Inventor: Laurence R. Sidebottom, Jr., 2585 Steiner Rd., Comins, MI (US) 48619

( * ) Notice: Subject to any disclaimer, the term of this patent is extended or adjusted under 35 U.S.C. 154(b) by 5 days.

(21) Appl. No.: 11/805,657

(22) Filed: May 24, 2007

(51) Int. Cl.
*B44D 3/38* (2006.01)

(52) U.S. Cl. ..... 33/408; 33/1 LE; 33/413

(58) Field of Classification Search ..... 33/409, 33/1 LE, 407, 408, 410, 414, 413
See application file for complete search history.

(56) References Cited

U.S. PATENT DOCUMENTS

| | | | | | |
|---|---|---|---|---|---|
| 1,080,836 | A | * | 12/1913 | Lake | 33/409 |
| 1,135,736 | A | | 4/1915 | Steuler | |
| 2,505,606 | A | * | 4/1950 | Coffey | 33/409 |
| 2,623,290 | A | * | 12/1952 | Everett | 33/409 |
| 2,663,938 | A | | 12/1953 | Stodgell | |
| 4,189,844 | A | | 2/1980 | Riggins, Sr. | |
| 4,561,189 | A | | 12/1985 | Hirneise | |
| 4,669,195 | A | | 6/1987 | Griffin | |
| 4,932,135 | A | * | 6/1990 | Wobser, II | 33/408 |
| 4,995,152 | A | | 2/1991 | Steckler | |
| 5,003,701 | A | * | 4/1991 | Hughes et al. | 33/409 |
| 6,082,014 | A | | 7/2000 | Beyers | |
| 6,415,519 | B1 | | 7/2002 | Bennett | |
| 6,931,743 | B1 | | 8/2005 | Scarborough | |
| 2002/0162237 | A1 | | 11/2002 | Bartimus | |

* cited by examiner

*Primary Examiner*—Christopher W Fulton
(74) *Attorney, Agent, or Firm*—Jeffrey A. Proehl; Woods, Fuller, Shultz & Smith, PC

(57) ABSTRACT

A chalk line anchoring device is disclosed for anchoring an end of a chalk line on a building element. The anchoring device may comprise an elongated base wall for positioning adjacent to an edge of the building element. The base wall has opposite ends and opposite sides. A notch is formed in the base wall for receiving a chalk line. A first side wall is mounted on and extends from the base wall, and a second side wall is mounted on and extends from the base wall. The anchoring device also includes structure for resisting movement with respect to the building element.

19 Claims, 6 Drawing Sheets

CHALK LINE ANCHORING DEVICE

BACKGROUND OF THE INVENTION

1. Field of the Invention

The present invention relates to chalk line aids and more particularly pertains to a new chalk line anchoring device for anchoring a portion of a line to an edge of a building element in a manner that secures the line portion in position with respect to the building element even when the line extends at non-perpendicular angles to the edge.

2. Description of the Prior Art

A number of devices have been proposed to provide various degrees of anchoring of a portion of a chalk line to a structure, such as a building element, to permit a line to be marked on the building element using the chalk or other substance on the line. While these devices may be somewhat effective for the intended purpose, it is believed that the devices disclosed in the art are not as useful as they could be, and are limited in their effectiveness when the line is to be extended and stretched in an orientation that is not perpendicular (or close to perpendicular) to the edge of the building element on which the device is mounted. Non-perpendicular orientations of the line tend to apply a force component to the device that is parallel to the edge, and can cause the device to slide along the edge, thus losing the desired positioning of the device and the line.

It is therefore believed that there is a need of a device for anchoring a chalk line that exhibits greater security in mounting on the edge of a building element, and is thus more resistant to being dislodged from the desired position when the attached line is stretched for line marking.

SUMMARY OF THE INVENTION

In view of the foregoing disadvantages inherent in the known types of chalk line aids now present in the prior art, the present invention provides a new chalk line anchoring device wherein the same can be utilized for anchoring a portion of a line to an edge of a building element in a manner that secures the line portion in position with respect to the building element even when the line extends at non-perpendicular angles to the edge.

To attain this, the present invention generally comprises a chalk line anchoring device for anchoring an end of a chalk line on a building element. The anchoring device comprises an elongated base wall for positioning adjacent to an edge of the building element. The base wall has opposite ends and opposite sides. A notch is formed in the base wall for receiving a line. A first side wall is mounted on and extending from the base wall and a second side wall mounted on and extending from the base wall. The anchoring device includes means for resisting movement with respect to the building element.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the ability to resist a high degree of force that is applied in a non-perpendicular orientation to the edge of the building element to thereby resist movement of the device when a non-perpendicular force is applied to the device by the line.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
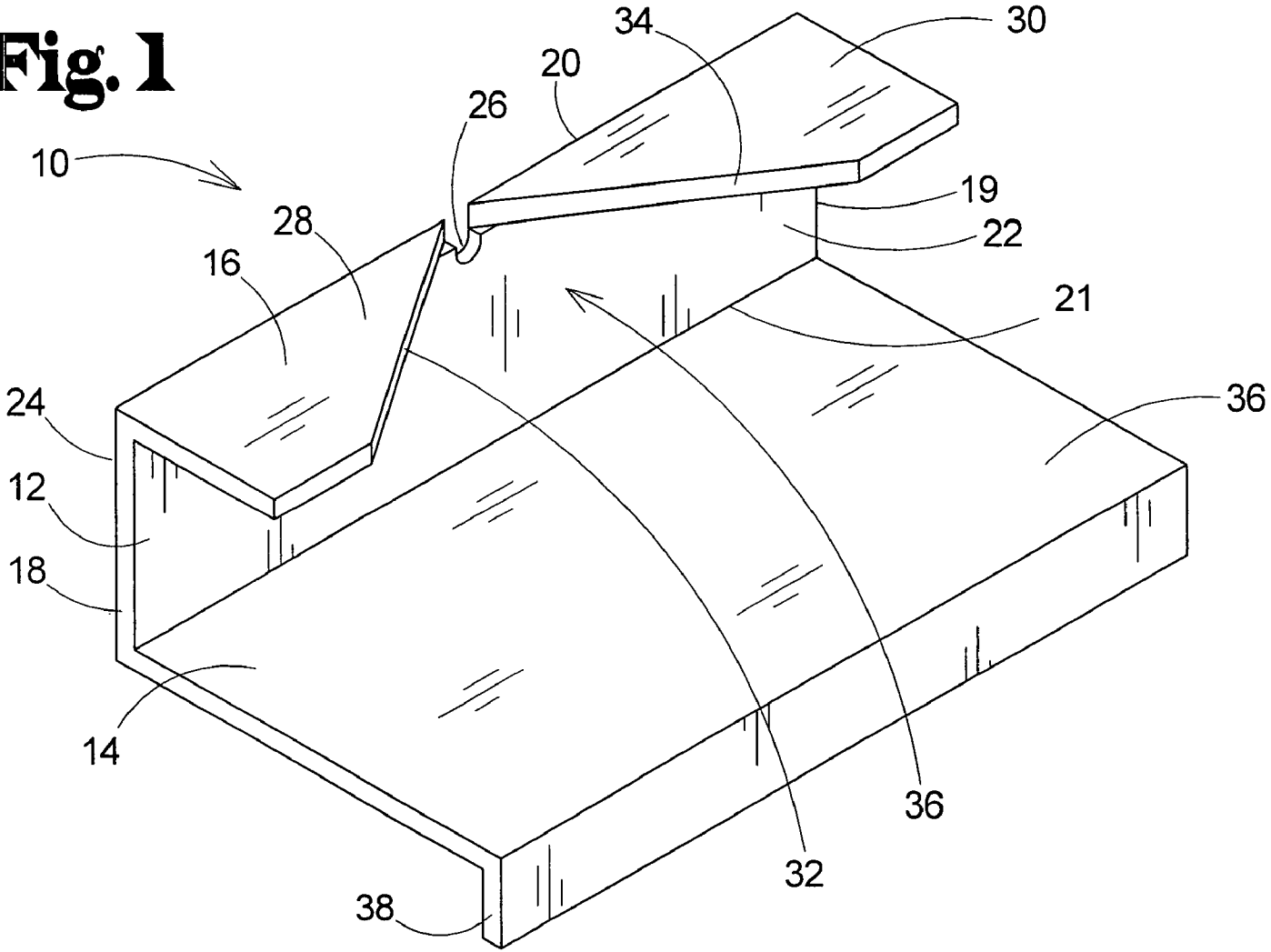
FIG. 1 is a schematic perspective view of one implementation of a new chalk line anchoring device according to the present invention.
Figure 2:
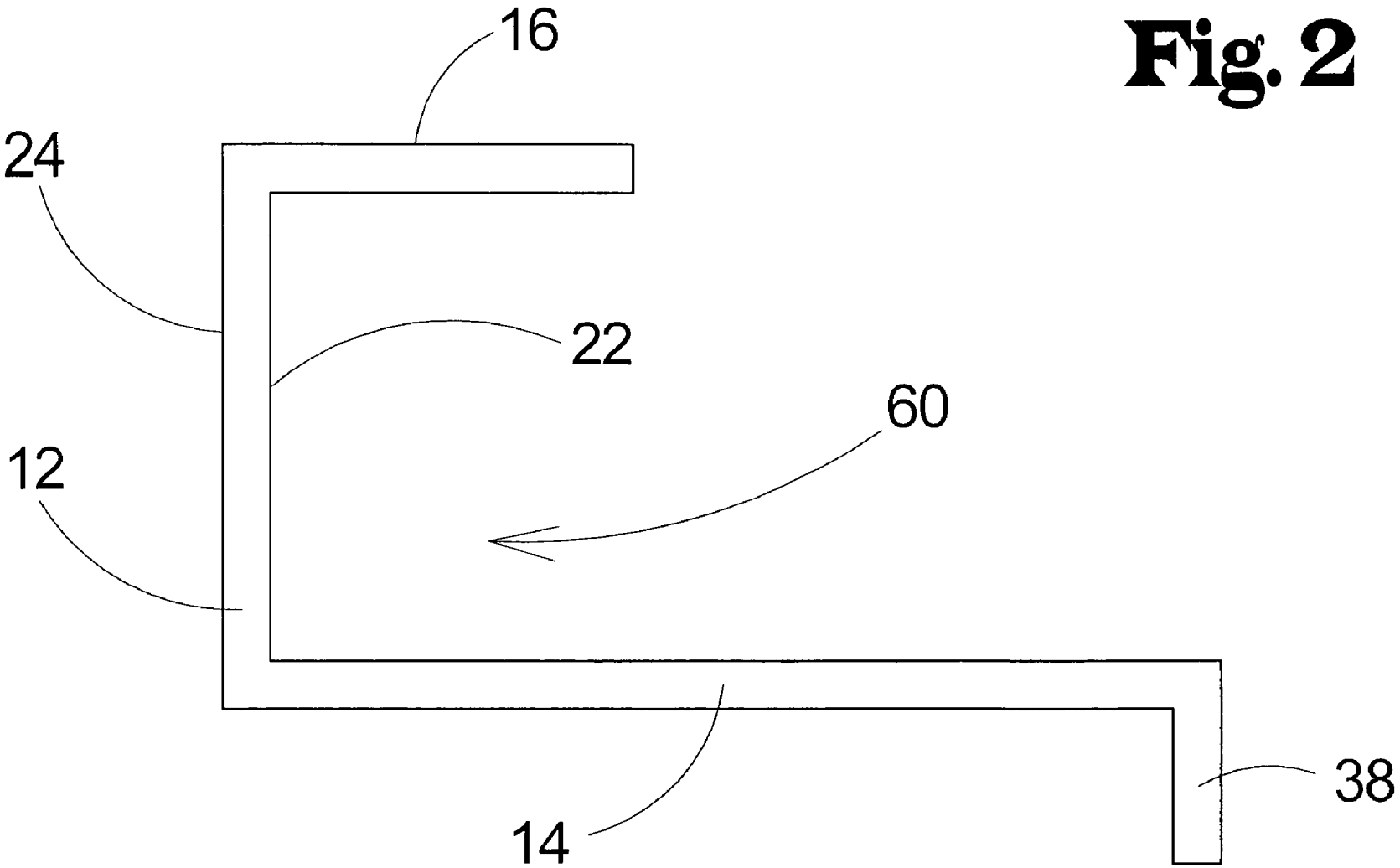
FIG. 2 is a schematic side view of the implementation of the present invention shown in FIG. 1.

With reference now to the drawings, and in particular to FIGS. 1 through 6 thereof, a new chalk line anchoring device embodying the principles and concepts of the present invention and generally designated by the reference numeral 10 will be described.

In general, the invention comprises a chalk line anchoring device 10 for use with a building element 1 that needs to be marked with a chalk line 2, and is suitable for anchoring an end 3 of the chalk line 2 on an edge 4 of the building element 1.

In various embodiments, the anchoring device 10 comprises an elongated base wall 12 for positioning adjacent to the edge 4 of the building element 1 during use, a first side wall 14 mounted on the base wall, and a second side wall mounted on the base wall.

In greater detail, the elongated base wall 12 has opposite ends 18, 19 and opposite sides 20, 21. The base wall 12 further has an inner surface 22 for positioning toward the building element 1 when the device is mounted on the building element, and an outer surface 24 positioned away from the building element 10 when the device is mounted on the building element. A notch 26 may be formed in the base wall 12 for receiving a portion of the chalk line 2 during use of the device 10. The notch 26 may extend from a second one 21 of the sides of the base wall 12.

The first side wall 14 is mounted on and extends from the base wall 12. The first side wall 14 may be mounted on the base wall 12 at a location towards a first one 20 of the sides of the base wall. The first side wall 14 may be oriented such that it extends substantially perpendicularly to a plane of the base wall 12 of the device 10.

The second side wall 16 is mounted on and extends from the base wall 12. The second side wall 16 may be mounted on the second one 21 of the sides of the base wall 12. The second side wall may be oriented substantially perpendicular to the base wall 12, such that the first side wall 14 and the second side wall 16 form a channel 60 with the base wall 12 for receiving a portion of the building element 1 during use.

In various embodiments of the anchoring device 10, the second side wall 6 may have a first section 28 and a second section 30. The first 28 and second 30 sections of the second side wall may be positioned on opposite sides of the notch 26 on the base wall. The first 28 and second 30 sections of the second side wall 16 have opposing edges 32 and 34 respectively. The opposing edges 32, 34 of the first 28 and second 30 sections of the second side wall 16 define an indentation 36. The indentation 36 may be in communication with the notch 26 in the base wall 12. The indentation 36 has a width that may be measured between the opposing side edges 32, 34 of the first 28 and second 30 sections, and the width of the indentation may decrease toward the base wall 12 and increase away from the base wall.

In some embodiments of the invention, a grip wall 38 is provided for facilitating finger gripping of the anchoring device 10, particularly during mounting and dismounting of the device 10 on the building element 1. The grip wall 38 may be mounted on the first side wall 14, and may extend from the first side wall 14 in a substantially perpendicular orientation to the first side wall 14. The grip wall 38 may also be oriented substantially parallel to the base wall 12.

The anchoring device 10 may also include structure 40 for resisting movement of the device with respect to the building element 10 when the device is mounted on the building element. In one implementation of the resisting structure 46 (shown in FIGS. 1 and 2), the first side wall 14 and second side wall 16 may converge to a slight degree away from the base wall 12 to permit the walls 14, 16 to exert a small degree of pinching force on the opposite faces of the building element 1 when the element 1 is inserted into the channel of the device 10.

Figure 3:
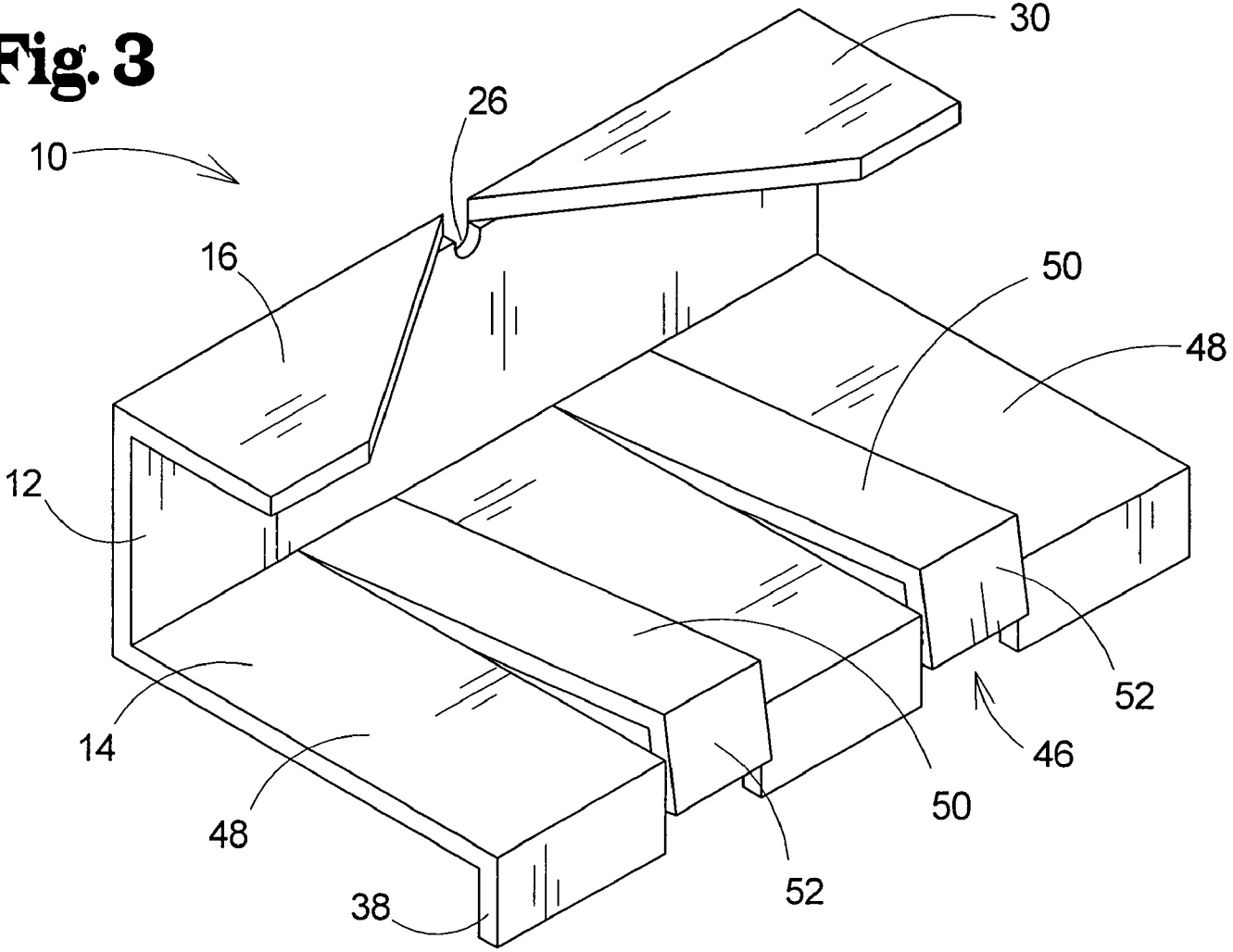
FIG. 3 is a schematic perspective view of another implementation of the present invention.
Figure 4:
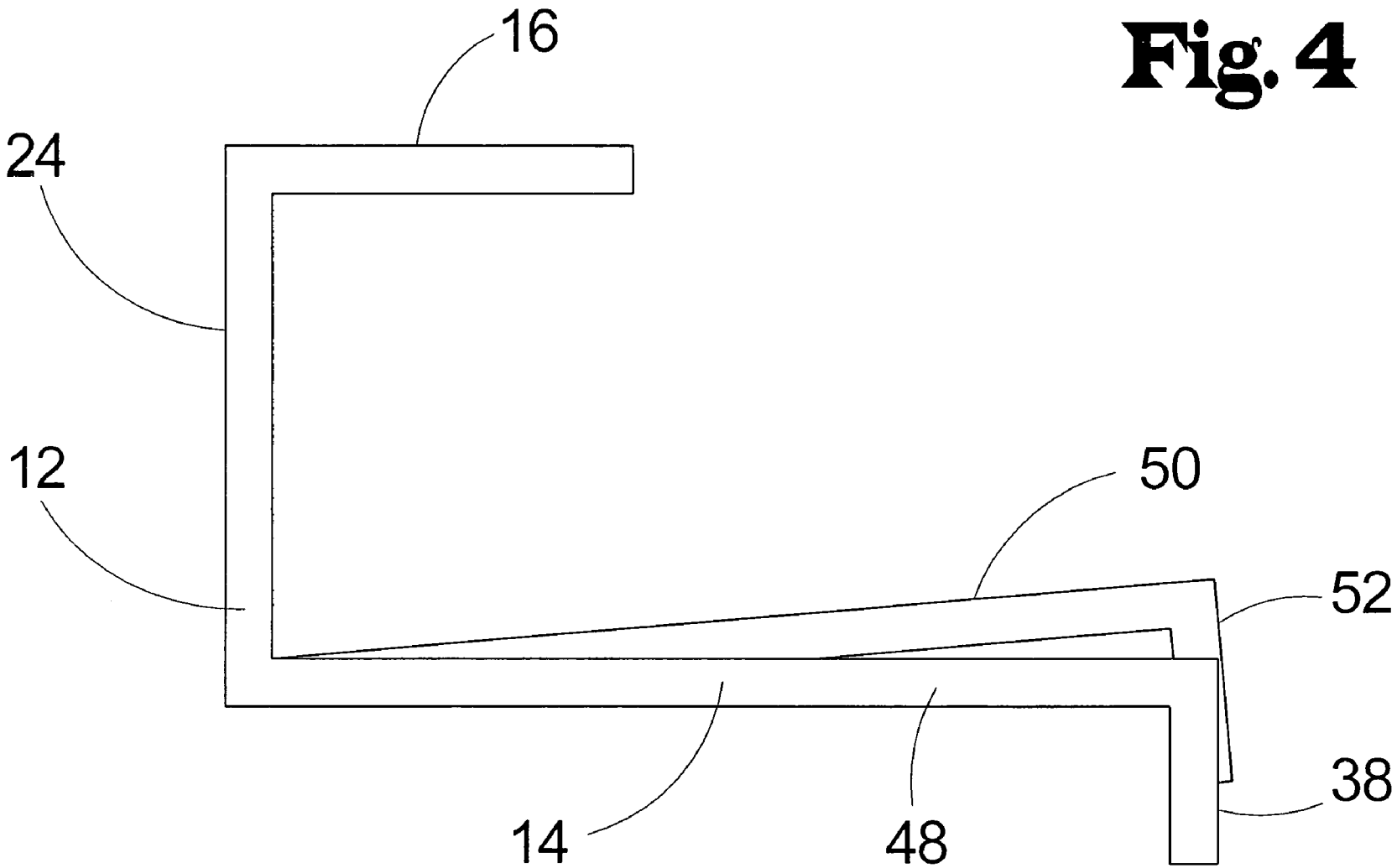
FIG. 4 is a schematic side view of the implementation of the present invention shown in FIG. 3.

In other embodiments of the anchoring device 10, such as is shown in FIGS. 3 and 4, may be located on the first side wall 14. In such embodiments of the invention, the first side wall 14 has a first section 48 lying in a plane oriented substantially perpendicular to the plane of the base wall 12, and the resisting structure 46 comprises a second section 50 of the first side wall 14 that is configured to press against the building element 1 when the anchoring device 10 is mounted on the building element 1. The second section 50 may be inclined or slanted inwardly toward the second side wall 16 relative to the first section 48 of the first side wall 14. As a result, an outboard end 52 of the second section 50 may be positioned inwardly of the plane of the first section 48 of the first side wall. In this way, the outboard end 52 of the second section 50 is biased against a side face of the building element when the device 10 is mounted on the element 1. In some embodiments, the first section 48 of the first side wall comprises two parts and the second section 50 comprises two parts.

Figure 5:
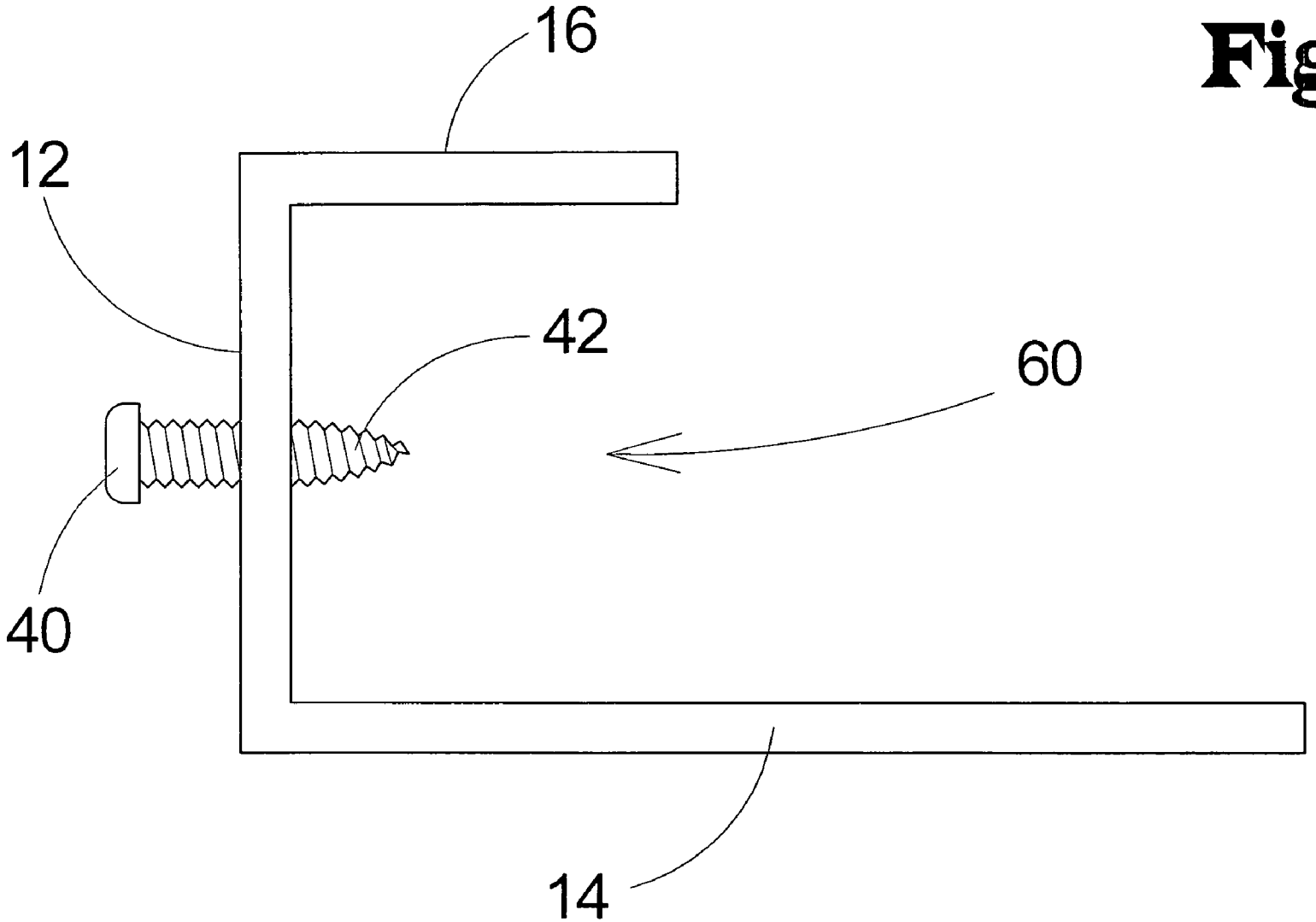
FIG. 5 is a schematic side view of yet another implementation of the present invention.
Figure 6:
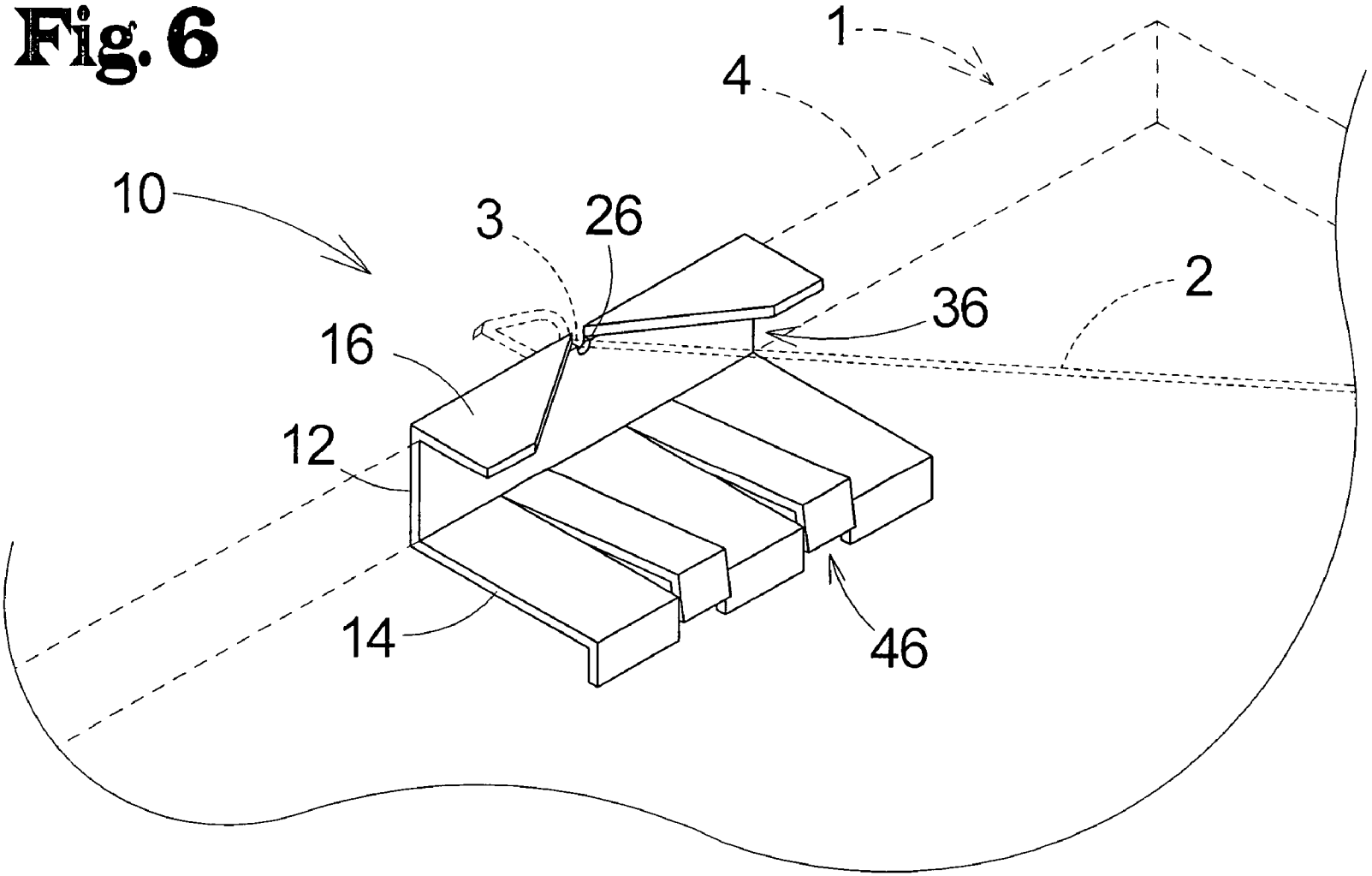
FIG. 6 is a schematic perspective view of the implementation of the present invention shown in FIG. 3 in a mounted condition on a building element and holding a chalk line in position on the building element.

In still other embodiments, such as is shown in FIG. 5, the resisting structure 40 is mounted on the base wall 12, and comprises at least one protrusion 42 located on and projecting from the inner surface 22 of the base wall 12. In various embodiments of the invention, a distance that the protrusion 42 protrudes from the inner surface 22 of the base wall 12 is adjustable. Illustratively, the protrusion 42 is formed of a screw 44 extending through the base wall 12, with the screw being threaded through an aperture formed in the base wall. Optionally, the resisting structure 40 comprises a pair of the protrusions 42 that are spaced longitudinally on the base wall 12.

It should be appreciated from the foregoing description that, except when mutually exclusive, the features of the various embodiments described herein may be combined with features of other embodiments as desired while remaining within the intended scope of the disclosure.

Preferably, but not necessarily or critically, the various walls of the anchoring device 10 may be formed from a transparent or semi-transparent material. The walls of the device 10 may also be formed from a single piece of a material, and may have some degree of resilient flexibility.

In use, the anchoring device 10 is mounted on a building element 1 such as a board by inserting an edge 4 of the building element into the channel formed by the base wall 12 with the first side wall 14 and the second side wall 16. This may be accomplished by grasping the grip wall 38 of the device 10 and sliding the edge 4 into the channel space between the first 12 and second 14 side walls. The device 10 may be slid along the edge 4 until the notch 26 in the base wall 12 is aligned with the desired positioning on the edge 4 of one end of the chalk line marking to be made. The building element 1 may not be completely inserted into the channel of the device 10 (e.g., positioned fully adjacent to the inner surface 22 of the base wall 12) prior to the final positioning of the device to facilitate movement of the device along the edge 4, but upon the positioning at the desired location, the building element may be more fully or completely inserted so that, for example, the protrusion 42 engages the edge 4 of the element 1. The chalk line 2 may be inserted into the notch 26 so that the end 3 of the chalk line is held in place in the notch. The line 2 may be stretched across a portion of the face of the building element and snapped to create the line marking. The line 2 may then be removed from the notch 4, and the device 10 removed from the building element by withdrawing the portion of the building element 1 from the channel of the device 10.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A chalk line anchoring device for anchoring an end of a chalk line on a building element, the anchoring device comprising:

an elongated base wall for positioning adjacent to an edge of the building element, the base wall having opposite ends and opposite sides, a notch being formed in the base wall for receiving a line;

a first side wall mounted on and extending from the base wall;

a second side wall mounted on and extending from the base wall; and a grip handle for facilitating finger gripping of the anchoring device, the grip handle being mounted on the first side wall, the grip handle extending from the first side wall in a direction away from the second side wall.

2. The chalk line anchoring device of claim 1 additionally comprising a grip wall for facilitating finger gripping of the anchoring device.

3. The chalk line anchoring device of claim 2 wherein the grip wall is mounted on the first side wall and extends from the first side wall.

4. The chalk line anchoring device of claim 2 wherein the grip wall being oriented substantially perpendicular to the first side wall.

5. The chalk line anchoring device of claim 1 wherein the first side wall is mounted on a first one of the sides of the base wall and the second side wall is mounted on a second one of the sides of the base wall in a spaced relationship to the first side wall to form a channel therebetween.

6. The chalk line anchoring device of claim 1 wherein the first side wall is oriented substantially perpendicular to the base wall and the second side wall is oriented substantially perpendicular to the base wall.

7. The chalk line anchoring device of claim 1 wherein the second side wall has a first section and a second section, the first and second sections being positioned on opposite sides of the notch, wherein the first and second sections have opposing edges, the opposing edges of the first and second sections of the second side wall defining an indentation, the indentation being in communication with the notch in the base wall.

8. The chalk line anchoring device of claim 7 wherein the indentation has a width measured between the opposing side edges of the first and second sections, the width of the indentation decreasing toward the base wall and increasing away from the base wall.

9. The chalk line anchoring device of claim 1 wherein the notch extends from a second one of the sides of the base wall.

10. The chalk line anchoring device of claim 1 wherein the resisting means is mounted on the base wall.

11. The chalk line anchoring device of claim 10 wherein the resisting means comprises at least one protrusion located on an inner surface of the base wall.

12. The chalk line anchoring device of claim 11 wherein a distance of the protrusion from the inner surface of the base wall is adjustable.

13. The chalk line anchoring device of claim 12 wherein the protrusion is formed of a screw extending through the base wall.

14. The chalk line anchoring device of claim 1 wherein the grip handle being oriented substantially perpendicular to the first side wall.

15. The chalk line anchoring device of claim 1 wherein the first side wall has a first section and a second section, the grip handle having a portion on the first section of the first side wall and a portion on the second section of the first side wall.

16. The chalk line anchoring device of claim 15 wherein the first section of the first side wall comprises two parts and the second section of the first side wall comprises two parts; and wherein the grip handle is located on each of the parts of the first and second sections of the first side wall.

17. A chalk line anchoring device for anchoring an end of a chalk line on a building element, the anchoring device comprising:

an elongated base wall for positioning adjacent to an edge of the building element, the base wall having opposite ends and opposite sides, a notch being formed in the base wall for receiving a line;

a first side wall mounted on and extending from the base wall; and a second side wall mounted on and extending from the base wall to form a channel between the first and second side walls, the second side wall having an edge located opposite of the base wall, the second side wall including an indentation extending from said edge toward the base wall, the indentation tapering toward and being in communication with the notch in the base wall;

wherein the first side wall has a first section lying in a plane oriented substantially perpendicular to a plane of the base wall, the first side wall having a second section being inclined inwardly with respect to the plane of the first section and toward the second side wall such that a width of the channel between the second section of the first side wall and the second side wall increases toward the base wall and decreases away from the base wall.

18. The chalk line anchoring device of claim 17 wherein the first section of the first side wall comprises two parts and the second section of the first side wall comprises two parts.

19. The chalk line anchoring device of claim 17 wherein the two parts of the first section of the first side wall and the two parts of the second section of the first side wall are arranged in an alternating manner.

* * * * *